US009879332B2

(12) United States Patent
Tanaka et al.

(10) Patent No.: US 9,879,332 B2
(45) Date of Patent: Jan. 30, 2018

(54) METHOD OF MANUFACTURING HIGH-STRENGTH STEEL SHEET FOR A CAN

(71) Applicant: JFE Steel Corporation, Tokyo (JP)

(72) Inventors: Takumi Tanaka, Fukuyama (JP); Katsumi Kojima, Fukuyama (JP); Makoto Aratani, Chiba (JP); Hiroki Iwasa, Kawasaki (JP)

(73) Assignee: JFE Steel Corporation (JP)

( * ) Notice: Subject to any disclaimer, the term of this patent is extended or adjusted under 35 U.S.C. 154(b) by 733 days.

(21) Appl. No.: 14/487,140

(22) Filed: Sep. 16, 2014

(65) Prior Publication Data

US 2015/0000798 A1 Jan. 1, 2015

Related U.S. Application Data

(62) Division of application No. 12/933,117, filed as application No. PCT/JP2009/056015 on Mar. 18, 2009, now abandoned.

(30) Foreign Application Priority Data

Mar. 19, 2008 (JP) ..... 2008-070517

(51) Int. Cl.

| | |
|---|---|
| ***C21D 8/02*** | (2006.01) |
| ***C21D 8/00*** | (2006.01) |
| ***B22D 11/00*** | (2006.01) |
| ***B22D 11/124*** | (2006.01) |
| ***C21D 8/04*** | (2006.01) |
| ***C22C 38/00*** | (2006.01) |
| ***C22C 38/02*** | (2006.01) |
| ***C22C 38/06*** | (2006.01) |
| ***C22C 38/04*** | (2006.01) |
| *C21D 9/48* | (2006.01) |

(52) U.S. Cl.

CPC ..... *C21D 8/005* (2013.01); *B22D 11/001* (2013.01); *B22D 11/124* (2013.01); *C21D 8/0436* (2013.01); *C21D 8/0442* (2013.01); *C21D 8/0473* (2013.01); *C22C 38/001* (2013.01); *C22C 38/02* (2013.01); *C22C 38/04* (2013.01); *C22C 38/06* (2013.01); *C21D 9/48* (2013.01); *C21D 2211/004* (2013.01); *C21D 2211/005* (2013.01)

(58) Field of Classification Search

CPC .... C21D 8/005; C21D 8/0436; C21D 8/0442; C21D 8/0473; C21D 2211/005; C21D 9/48; C21D 2211/004; C22C 38/04; C22C 38/06; C22C 38/001; C22C 38/02; B22D 11/001; B22D 11/124

USPC ..... 148/541, 653

See application file for complete search history.

(56) References Cited

U.S. PATENT DOCUMENTS

| | | | | |
|---|---|---|---|---|
| 4,023,987 | A | 5/1977 | Nomura et al. | |
| 4,838,955 | A | 6/1989 | Edelman et al. | |
| 5,578,143 | A * | 11/1996 | Koyama | B22D 11/00 148/319 |
| 6,156,131 | A | 12/2000 | Sardoy et al. | |
| 2006/0137770 | A1 | 6/2006 | Bouzekri | |
| 2009/0250147 | A1 | 10/2009 | Nishida et al. | |

FOREIGN PATENT DOCUMENTS

| | | | |
|---|---|---|---|
| EP | 1 006 203 | A1 | 6/2000 |
| EP | 1 065 282 | A1 | 1/2001 |
| EP | 1 741 800 | A1 | 1/2007 |
| EP | 2 253 729 | A1 | 11/2010 |
| EP | 2 253 729 | B1 | 7/2015 |
| JP | 59-50125 | A | 3/1984 |
| JP | 62-30848 | A | 2/1987 |
| JP | 01-116030 | A | 5/1989 |
| JP | 5-195073 | A | 8/1993 |
| JP | 8-325670 | A | 12/1996 |
| JP | 10-60592 | A | 3/1998 |
| JP | 2000-26921 | A | 1/2000 |
| JP | 2000-160289 | A | 6/2000 |
| JP | 2005-336610 | A | 12/2005 |
| JP | 2007-160341 | A | 6/2007 |
| WO | 2008/018531 | A1 | 2/2008 |

OTHER PUBLICATIONS

Supplementary European Search Report dated Nov. 28, 2013 from corresponding European Patent Application No. EP 09 72 2774.

(Continued)

*Primary Examiner* — Kiley Stoner

(74) *Attorney, Agent, or Firm* — DLA Piper LLP (US)

(57) ABSTRACT

A method of manufacturing a high-strength steel sheet includes, on a mass percent basis, 0.03%-0.10% C, 0.01%-0.5% Si, 0.001%-0.100% P, 0.001%-0.020% S, 0.01%-0.10% Al, 0.005%-0.012% N, the balance being Fe and incidental impurities, and microstructures that do not contain a pearlite microstructure, wherein, when Mnf=Mn [% by mass]−1.71×S [% by mass], Mnf is 0.3 to 0.6, including: forming a slab by vertical-bending type continuous casting or bow type continuous casting, wherein surface temperature of a slab corner in a region where the slab undergoes bending deformation or unbending deformation is 800° C. or lower, or 900° C. or higher; forming a steel sheet by hot-rolling the slab followed by cold rolling; annealing the steel sheet after the cold rolling; and skinpass rolling at a draft of 3% or less after the annealing.

5 Claims, No Drawings

(56) References Cited

OTHER PUBLICATIONS

European Communication of a Notice of Opposition dated Apr. 12, 2016, of corresponding European Application No. 09722774.8.
European Communication of a Notice of Opposition dated May 10, 2016, of corresponding European Application No. 09722774.8.
Europälsches Komitee für Normung, "Kaltgewalzte Verpackungsblecherzeugnisse—Elektrolytisch verzinnter und spezlalverchromter Stahl" CEN, No. EN1020, März 2001, Ursprünglicher Datelname: D11+_DIN EN 10202-Deutsch.pdf, Beigefügt als: Published-Evidence-11.pdf, along with an English summary.

* cited by examiner

METHOD OF MANUFACTURING HIGH-STRENGTH STEEL SHEET FOR A CAN

TECHNICAL FIELD

This disclosure relates to a steel sheet for a can, the steel sheet having high strength and being free from slab cracking during continuous casting, and a method of manufacturing the steel sheet.

BACKGROUND

In recent years, cost-cutting measures for the manufacturing cost of cans have been taken to expand the demand for steel cans. An example of the cost-cutting measures for the manufacturing cost of cans is a reduction in raw-material cost. Progress has been made in reducing the thicknesses of steel sheets used for both two-piece cans, which are formed by drawing, and three-piece cans, which are mainly formed by cylinder forming. However, a simple reduction in the thickness of a conventional steel sheet reduces the strength of a can body. Thus, high-strength thin steel sheet for a can is desired for these uses.

As a method for manufacturing high-strength steel sheet for a can, JP 5-195073 discloses a method including subjecting a steel containing 0.07%-0.20% C, 0.50%-1.50% Mn, 0.025% or less S, 0.002%-0.100% Al, and 0.012% or less N to rolling, continuous annealing, and skin pass rolling to afford a steel sheet having a proof stress of 56 kgf/mm$^2$ or more.

JP 59-50125 discloses a method including subjecting a steel containing 0.13% or less C, 0.70% or less Mn, 0.050% or less S, and 0.015% or less N to rolling and continuous annealing and that a steel sheet has a yield stress of about 65 kgf/mm$^2$ after lacquer baking in an Example.

JP 62-30848 discloses a method including subjecting a steel containing 0.03%-0.10% C, 0.15%-0.50% Mn, 0.02% or less S, 0.065% Al, and 0.004%-0.010% N to rolling, continuous annealing, and skin pass rolling to afford a steel sheet having a yield stress of 500±50 N/mm$^2$.

JP 2000-26921 discloses a method including subjecting a steel containing 0.1% or less C and 0.001%-0.015% N to rolling, continuous annealing, overaging, and skin pass rolling to afford a steel sheet having a temper designation of up to T6 (a hardness of about 70 (HR30T)).

Nowadays, a steel sheet having a yield strength of about 420 MPa is used for bodies of three-piece cans. The steel sheet is required to have a thickness reduced by several percent. It is necessary to have a yield strength of 450 MPa or more to meet the requirement and maintain the strength of can bodies.

When a steel having high C and N contents is produced and formed into a slab, cracking can occur at a corner (hereinafter, referred to as a "slab corner") of a long side and a short side of the cross section of the slab in a continuous casting process. In the case of a vertical-bending type or bow type continuous casting machine, the slab undergoes bending deformation or unbending deformation (only in the vertical-bending type continuous casting machine) at high temperatures. Such a steel with high C and N contents has poor high temperature ductility, thus causing cracking during deformation. When the slab corner is cracked, it is necessary to perform, for example, surface grinding. This disadvantageously causes a reduction in yield and an increase in cost.

In the present circumstances, the high-strength steel sheets described in the related art have high proportions of C and N, which function as solid-solution strengthening elements, and thus are highly likely to be cracked at slab corners in a continuous casting process.

It could therefore be helpful to provide a steel sheet for a can, the steel sheet having a yield strength of 450 MPa or more and being free from cracking at a slab corner in a continuous casting process, and a method of manufacturing the steel sheet for a can.

SUMMARY

We subjected a steel having the same composition as a steel in which cracking occurred at a slab corner to a high-temperature tensile test. Observation of a fracture due to brittle cracking with a scanning electron microscope showed that cracking occurred along Fe grain boundaries and precipitates were present on the grain boundaries. The precipitates were analyzed and found to be MnS and AlN. These compounds have poor ductilities and can make grain boundaries brittle. The possibility exists that at high C and N contents, the insides of the grains do not easily extend because of solid-solution strengthening and that stress concentration occurs at the brittle grain boundaries to easily cause cracking.

For the manufacture of a high-strength steel sheet, we found that it is essential that the steel sheet has considerable proportions of C and N, which function as solid-solution strengthening elements. Thus, measures to improve the ductility in the insides of Fe grains by reducing the proportions of C and N cannot be taken to solve the cracking at the slab corner. So, we focused on the S and Al contents and found that reductions in S and Al contents prevent the precipitation of MnS and AlN on grain boundaries and the cracking at the slab corner.

That is, our attention focused on a combination of solid-solution strengthening and grain refinement strengthening, achieving solid-solution strengthening using solid-solution strengthening elements such as C and N and solid-solution strengthening and grain refinement strengthening using P and Mn. This results in a yield strength of 450 to 470 MPa. Furthermore, a low S and/or Al content makes it possible to prevent cracking at a slab corner in continuous casting regardless of high C and N contents.

Moreover, the ductility of the steel described above is reduced in the range above 800° C. and below 900° C. Thus, the operation is performed in such a manner that the temperatures of a slab corner in a region (hereinafter, referred to as a "correction zone") where a slab undergoes bending deformation or unbending deformation in continuous casting are not within the temperature range, thereby more assuredly preventing the cracking at the slab corner. As described above, the control of the ingredients on the basis of the foregoing findings has led to the completion of a high-strength steel sheet for cans.

We thus provide:

[1] A high-strength steel sheet for a can includes, on a mass percent basis, 0.03%-0.10% C, 0.01%-0.5% Si, 0.001%-0.100% P, 0.001%-0.020% S, 0.01%-0.10% Al, 0.005%-0.012% N, the balance being Fe and incidental impurities, and microstructures that do not contain a pearlite microstructure, wherein when Mnf=Mn [% by mass]−1.71×S [% by mass], Mnf is in the range of 0.3 to 0.6.

[2] In the high-strength steel for a can sheet described in [1], on a mass percent basis, the S content is in the range of 0.001% to 0.005%, and/or the Al content is in the range of 0.01% to 0.04%.

[3] In the high-strength steel sheet for a can described in [1] or [2], the yield strength is in the range of 450 to 470 MPa after a lacquer baking treatment performed at 210° C. for 20 minutes.

[4] A method of manufacturing a high-strength steel sheet for a can described in [1] to [3] includes a process of making a slab by vertical-bending type continuous casting or bow type continuous casting, the surface temperature of a slab corner in a region where a slab undergoes bending deformation or unbending deformation being set to a temperature not higher than 800° C. or a temperature not lower than 900° C., and an annealing process after cold rolling, an annealing temperature being set to less than the $A_1$ transformation point.

Hereinafter, % indicates the units of the content of each ingredient in the steel and means % by mass. Furthermore, the term "high-strength steel sheet for a can" is used to indicate a steel sheet for a can, the steel sheet having a yield strength of 450 MPa or more.

DETAILED DESCRIPTION

A steel sheet for a can is a high-strength steel sheet for a can, the steel sheet having a yield strength of 450 MPa or more. Solid-solution strengthening using C and N and solid-solution strengthening and grain refinement strengthening using P and Mn result in a steel sheet having a higher strength than a conventional steel sheet for a can, the conventional steel sheet having a yield strength of 420 MPa.

The ingredient composition of a steel sheet for a can will be described below.

C: 0.03% to 0.10%

In a steel sheet for a can, it is essential to achieve predetermined strength or more (a yield strength of 450 MPa or more) after continuous annealing, skin pass rolling, and lacquer baking. In the case of manufacturing a steel sheet that satisfies the properties, the amount of C added is important, C functioning as a solid-solution strengthening element. The lower limit of the C content is set to 0.03%. Meanwhile, at a C content exceeding 0.10%, cracking at a slab corner is not prevented even when S and Al contents are regulated in a range described below. Thus, the upper limit of the C content is set to 0.10%. Preferably, the C content is in the range of 0.04% to 0.07%.

Si: 0.01% to 0.5%

Si is an element that increases the strength of steel by solid-solution strengthening. A large amount of Si added causes a significant reduction in corrosion resistance. Thus, the Si content is in the range of 0.01% to 0.5%.

P: 0.001% to 0.100%

P is an element that has a great ability for solid-solution strengthening. A large amount of P added causes a significant reduction in corrosion resistance. Thus, the upper limit is set to 0.100%. Meanwhile, a P content of less than 0.001% causes an excessively large dephosphorization cost. Thus, the lower limit of the P content is set to 0.001%.

S: 0.001% to 0.020%

S is an impurity derived from a blast furnace feed material. S combines with Mn in steel to form MnS. The precipitation of MnS at grain boundaries at high temperatures leads to embrittlement. Meanwhile, the addition of Mn is needed to ensure strength. It is necessary to reduce the S content to inhibit the precipitation of MnS, thereby preventing cracking at a slab corner. Thus, the upper limit of the S content is set to 0.020% and preferably 0.005% or less. Furthermore, a S content of less than 0.001% causes an excessively large desulfurization cost. Thus, the lower limit is set to 0.001%.

Al: 0.01% to 0.10%

Al functions as a deoxidant and is an element needed to increase the cleanness of steel. However, Al combines with N in steel to form AlN. Like MnS, this segregates at grain boundaries to cause high-temperature embrittlement. A large amount of N is contained to ensure strength. Thus, to prevent embrittlement, it is necessary to reduce the Al content. Hence, the upper limit of the Al content is set to 0.10% and preferably 0.04% or less. Meanwhile, an Al content of a steel of less than 0.01% can cause insufficient deoxidation. The lower limit of the Al content is therefore set to 0.01%.

N: 0.005% to 0.012%

N is an element that contributes to solid-solution strengthening. To provide the effect of solid-solution strengthening, N is preferably added in an amount of 0.005% or more. Meanwhile, a large amount of N added causes a deterioration in hot ductility, so that cracking at a slab corner is inevitable even when the S content is regulated within the range described above. Thus, the upper limit of the N content is set to 0.012%.

Mn: when Mnf=Mn [% by mass]−1.71×S [% by mass], Mnf is in the range of 0.3 to 0.6

Mn increases the strength of steel by solid-solution strengthening and reduces the size of grains. Mn combines with S to form MnS. Thus, the amount of Mn that contributes to solid-solution strengthening is regarded as an amount obtained by subtracting the amount of Mn to be formed into MnS from the amount of Mn added. In consideration of the atomic weight ratio of Mn to S, the amount of Mn that contributes to solid-solution strengthening is expressed as Mnf=Mn [% by mass]−1.71×S [% by mass]. A Mnf of 0.3 or more results in a significant effect of reducing the grain size. To ensure target strength, it is necessary to achieve a Mnf of at least 0.3. Thus, the lower limit of Mnf is limited to 0.3. Meanwhile, an excessive amount of Mnf results in poor corrosion resistance. Thus, the upper limit of Mnf is limited to 0.6.

The balance is set to Fe and incidental impurities.

The reason for the limitation of the microstructures will be described below.

The steel has microstructures that do not contain a pearlite microstructure. The pearlite microstructure is a lamellar microstructure of ferrite phases and cementite phases. The presence of a coarse pearlite microstructure causes voids and cracks due to stress concentration, reducing the ductility in a temperature region below the $A_1$ transformation point. A three-piece beverage can may be subjected to necking in which both ends of the can body are reduced in diameter. Furthermore, to roll the top and the bottom into flanges, flanging is performed in addition to necking Insufficient ductility at room temperature causes cracking in a steel sheet during the severe processing. Thus, to avoid a reduction in ductility at room temperature, the microstructures do not contain the pearlite microstructure.

A method for manufacturing a steel sheet for a can will be described below.

Investigation of the high-temperature ductility of a steel sheet having the foregoing ingredient composition showed that the ductility was reduced at a temperature above 800° C. and below 900° C. To more surely prevent cracking at a slab corner, it is desired to adjust the operation conditions of continuous casting and allow the surface temperature of the slab corner in the correction zone to be outside the foregoing temperature range. That is, continuous casting is performed to make a slab in such a manner that the surface temperature of the slab corner in the correction zone is 800° C. or lower, or 900° C. or higher.

Next, hot rolling is performed. The hot rolling may be performed according to a common method. The thickness after the hot rolling is not particularly specified. To reduce a load imposed during cold rolling, the thickness is preferably 2 mm or less. The finishing temperature and the winding temperature are not particularly specified. To provide a uniform microstructure, the finishing temperature is preferably set to 850° C. to 930° C. To prevent an excessively increase in the size of ferrite grains, the winding temperature is preferably set to 550° C. to 650° C.

After pickling is performed, cold rolling is performed. The cold rolling is preferably performed at a draft of 80% or more. This is performed to crush pearlite microstructures formed after the hot rolling. A draft of less than 80% in the cold rolling allows the pearlite micro-structures to be left. Thus, the draft in the cold rolling is set to 80% or more. The upper limit of the draft is not particularly specified. An excessively large draft causes an excessively large load imposed on a rolling mill, leading to faulty rolling. Hence, the draft is preferably 95% or less.

After the cold rolling, annealing is performed. At this point, the annealing temperature is set to a temperature below the $A_1$ transformation point. An annealing temperature of the $A_1$ transformation point or higher causes the formation of an austenite phase during the annealing. The austenite phase is transformed into pearlite microstructures in a cooling process after the annealing. Thus, the annealing temperature is set to a temperature below the $A_1$ transformation point. As an annealing method, a known method, for example, continuous annealing or batch annealing, may be employed.

After the annealing process, skin pass rolling, plating, and so forth are performed according to common methods.

EXAMPLE

Steels having ingredient compositions shown in Table 1 and containing the balance being Fe and incidental impurities were produced in an actual converter and each formed into a steel slab by vertical-bending type continuous casting at a casting speed of 1.80 mpm. At this time, a thermocouple was brought into contact with a slab corner in a region (upper correction zone) where the slab underwent bending deformation and a region (lower correction zone) where the slab underwent unbending deformation by continuous casting, measuring the surface temperature. Slabs in which cracking had occurred at their corners were subjected to surface grinding (scarfing) so that the cracking may not adversely affect the subsequent processes.

Next, the resulting steel slabs were reheated to 1250° C., hot-rolled at a roll finishing temperature ranging from 880° C. to 900° C., cooled at an average cooling rate of 20 to 40° C./s until winding, and wound at a winding temperature ranging from 580° C. to 620° C. After pickling, cold rolling was performed at a draft of 90% or more, affording steel sheets for a can, each of the steel sheets having a thickness of 0.17 to 0.2 mm.

The resulting steel sheets for a can were heated at 15° C./sec and subjected to continuous annealing at annealing temperatures shown in Table 1 for 20 seconds. After cooling, skin pass rolling was performed at a draft of 3% or less. Common chromium plating was continuously performed, affording tin-free steel.

After the resulting plated steel sheets (tin-free steel) were subjected to heat treatment comparable to lacquer baking at 210° C. for 20 minutes, a tensile test was performed. Specifically, each of the steel sheets was processed into tensile test pieces of JIS-5 type. The tensile test was performed with an Instron tester at 10 mm/min to measure the yield strength.

To evaluate ductility at room temperature, a notched tensile test was also performed. Each of the steel sheets was processed into a tensile test piece having a width of the parallel portion of 12.5 mm, a length of the parallel portion of 60 mm, and a gauge length of 25 mm. A V-notch with a depth of 2 mm was made on each side of the middle of the parallel portion. The resulting test pieces were used for the tensile test. Test pieces each having an elongation at break of 5% or more were evaluated as pass (P). A test piece having an elongation at break of less than 5% was evaluated as fail (F).

Furthermore, after the heat treatment described above, the cross section of each of the steel sheets was polished. The grain boundaries were etched with Nital. The microstructures were observed with an optical microscope.

Table 1 shows the results together with the conditions.

TABLE 1

(percent by mass)

| Steel | C | Si | P | S | N | Al | Mnf | Surface temperature at slab corner (mean temperature ° C.) Upper correction zone | Lower correction zone | Annealing temperature (° C.) | Slab cracking | Pearlite | Yield strength (MPa) | Ductility at room temperature | Remarks |
|---|---|---|---|---|---|---|---|---|---|---|---|---|---|---|---|
| 1 | 0.06 | 0.01 | 0.022 | 0.004 | 0.009 | 0.04 | 0.5 | 685 | 750 | 710 | None | None | 455 | P | Example |
| 2 | 0.05 | 0.02 | 0.040 | 0.005 | 0.010 | 0.03 | 0.6 | 716 | 774 | 700 | None | None | 458 | P | Example |
| 3 | 0.07 | 0.01 | 0.097 | 0.004 | 0.005 | 0.04 | 0.5 | 914 | 985 | 700 | None | None | 460 | P | Example |
| 4 | 0.03 | 0.01 | 0.059 | 0.003 | 0.006 | 0.06 | 0.5 | 620 | 655 | 710 | None | None | 455 | P | Example |
| 5 | 0.10 | 0.01 | 0.077 | 0.006 | 0.011 | 0.03 | 0.3 | 695 | 786 | 695 | None | None | 461 | P | Example |
| 6 | 0.08 | 0.02 | 0.006 | 0.004 | 0.010 | 0.03 | 0.4 | 918 | 958 | 695 | None | None | 470 | P | Example |
| 7 | 0.04 | 0.01 | 0.081 | 0.005 | 0.006 | 0.10 | 0.5 | 741 | 791 | 700 | None | None | 452 | P | Example |
| 8 | 0.09 | 0.02 | 0.088 | 0.012 | 0.009 | 0.03 | 0.6 | 989 | 1050 | 710 | None | None | 466 | P | Example |
| 9 | 0.06 | 0.02 | 0.042 | 0.005 | 0.010 | 0.06 | 0.2 | 731 | 766 | 710 | None | None | 434 | P | Comparative Example |

TABLE 1-continued (percent by mass)

| Steel | C | Si | P | S | N | Al | Mnf | Surface temperature at slab corner (mean temperature ° C.) Upper correction zone | Lower correction zone | Annealing temperature (° C.) | Slab cracking | Pearlite | Yield strength (MPa) | Ductility at room temperature | Remarks |
|---|---|---|---|---|---|---|---|---|---|---|---|---|---|---|---|
| 10 | 0.05 | 0.01 | 0.060 | 0.003 | 0.002 | 0.04 | 0.4 | 723 | 747 | 700 | None | None | 430 | P | Comparative Example |
| 11 | 0.08 | 0.01 | 0.040 | 0.025 | 0.006 | 0.03 | 0.5 | 756 | 772 | 700 | Observed | None | 463 | P | Comparative Example |
| 12 | 0.07 | 0.02 | 0.032 | 0.004 | 0.008 | 0.18 | 0.4 | 784 | 795 | 705 | Observed | None | 459 | P | Comparative Example |
| 13 | 0.05 | 0.02 | 0.016 | 0.008 | 0.008 | 0.04 | 0.3 | 860 | 915 | 695 | Observed | None | 458 | P | Comparative Example |
| 14 | 0.06 | 0.02 | 0.035 | 0.003 | 0.007 | 0.09 | 0.6 | 791 | 831 | 700 | Observed | None | 461 | P | Comparative Example |
| 15 | 0.10 | 0.01 | 0.019 | 0.004 | 0.007 | 0.02 | 0.5 | 705 | 749 | 850 | None | Observed | 453 | F | Comparative Example |

Table 1 shows that each of Samples 1 to 8, which are Examples, has excellent strength and a yield strength of 450 MPa or more required for a reduction in the thickness of the can body of a three-piece can by several percent. Furthermore, the results demonstrate that no cracking occurs at a slab corner during the continuous casting.

Samples 9 and 10, which are Comparative Examples, are small in Mnf and N, respectively, thus leading to insufficient strength. Samples 11 and 12 have a high S content and a high Al content, respectively. Samples 13 and 14 have the surface temperatures of the slab corners within the region above 800° C. and below 900° C. in the upper correction zone and the lower correction zone, respectively, the region being outside our range. Hence, cracking occurred at the slab corners. In Sample 15, the annealing temperature is the $A_1$ transformation point or higher. Hence, the microstructure contains pearlite at room temperature, leading to insufficient ductility at room temperature.

INDUSTRIAL APPLICABILITY

A steel sheet for a can has a yield strength of 450 MPa or more without cracking at a slab corner in a continuous casting process and can be suitably used for can bodies, can lids, can bottoms, tabs, and so forth of three-piece cans.

The invention claimed is:

1. A method of manufacturing a high-strength steel sheet consisting of, on a mass percent basis, 0.03%-0.10% C, 0.01%-0.5% Si, 0.001%-0.100% P, 0.001%-0.020% S, 0.01%-0.10% Al, 0.005%-0.012% N, the balance being Fe and incidental impurities, and microstructures that do not contain a pearlite microstructure, wherein, when Mnf=Mn [% by mass]−1.71×S [% by mass], Mnf is 0.3 to 0.6, comprising:

forming a slab by vertical-bending type continuous casting or bow type continuous casting, wherein surface temperature of a slab corner in a region where the slab undergoes bending deformation or unbending deformation is 800° C. or lower, or 900° C. or higher;

forming a steel sheet by hot-rolling the slab followed by cold rolling;

annealing the steel sheet after the cold rolling; and skinpass rolling at a draft of 3% or less after the annealing.

2. The method according to claim 1, wherein, on a mass percent basis, the Al content is 0.01% to 0.04%.

3. The method according to claim 2, wherein, on a mass percent basis, the S content is 0.001% to 0.005%.

4. The method according to claim 3, wherein, on a mass percent basis, the C content is 0.04% to 0.07%.

5. The method according to claim 1, wherein the cold rolling is performed at a draft of 80% or more and the annealing temperature is less than the $A_1$ transformation point.

* * * * *